United States Patent [19]

Cheatham et al.

[11] 4,077,627

[45] Mar. 7, 1978

[54] TENNIS RACKET WITH DETACHABLE HANDLE

[76] Inventors: Guy R. Cheatham, 1520 Man O War Dr., Floressant, Mo. 63033; Ralph W. Fisher, 619 Riverview La., St. Charles, Mo. 63301

[21] Appl. No.: 688,096

[22] Filed: May 19, 1976

[51] Int. Cl.[2] ..... A63B 49/02

[52] U.S. Cl. ..... 273/73 R

[58] Field of Search ..... 273/68, 73 R, 73 C, 273/73 H, 73 J, 75, 81 R; 403/13, 14, 258, 260, 408; 145/2 R, 3, 29, 61 R

[56] References Cited

U.S. PATENT DOCUMENTS

| | | | |
|---|---|---|---|
| 1,026,990 | 5/1912 | Matson | 273/73 J X |
| 2,284,214 | 5/1942 | Kelly | 403/208 |
| 2,463,621 | 3/1949 | Herzog | 273/73 G X |
| 3,833,218 | 9/1974 | Frenkel et al. | 273/73 J |
| 4,007,929 | 2/1977 | Figa | 273/73 R |

FOREIGN PATENT DOCUMENTS

| | | | |
|---|---|---|---|
| 834,230 | 3/1952 | Germany | 403/260 |

*Primary Examiner*—Richard J. Apley
*Attorney, Agent, or Firm*—George W. Finch

[57] ABSTRACT

A tennis racket of wood, composite materials or metal having a handle which is detachably held to the head of the racket by means of an elongated tension rod which extends therebetween and can apply sufficient force to maintain a pair of mating butt plates together during use of the racket. Release of the tension rod enables separation of the head and handle of the racket at the juncture of the butt plates.

5 Claims, 8 Drawing Figures

TENNIS RACKET WITH DETACHABLE HANDLE

BACKGROUND OF THE INVENTION

With the recent growth in the popularity of the game of tennis, more and more players are carrying their tennis equipment with them while traveling for business or for pleasure. Tennis balls, clothes and shoes are easily carried but a major difficulty exists in the transporting of a tennis racket particularly on commercial airlines. Most avid tennis players are not willing to check their racket with their other luggage for fear of losing it or having it broken or somehow damaged. They are therefore forced to carry their racket with them to their seat inside the cabin of the airliner. Since airline regulations will not permit the placement of objects such as tennis rackets on the overhead cabin racks, the player must either hold the racket in his lap or place it on the floor under the forward seat during the trip. Either alternative is inconvenient, and perhaps even worse, other travelers become aware that the tennis player is carrying his racket. Many times a traveling business man would prefer to take his tennis racket on the trip without others knowing that he has recreation as well as business in mind.

BRIEF SUMMARY OF THE INVENTION

The present tennis racket with a detachable handle described herein facilitates the transportation thereof on any trip but especially on airlines where space is at a premium. The racket is usually a wood or composite tennis racket which has been modified so that the handle separates just below the throat of the racket for easy storage and transportation in a briefcase, suitcase or clothes bag. This separation is facilitated by a pair of matching butt plates which are attached to the two portions of the racket at the separation line therebetween. The butt plates include alignment and torque transmission means. These means cause the racket to feel like a solid racket when the butt plates are forced together by means of a tension rod. The rod extends through the handle and into the throat area of the racket where it engages suitable threaded means. When needed for play, the present racket can be assembled easily in less than a minute using only simple torque application means such as a hand wrench applied to the rod at the base of the handle.

It is therefore an object of the present invention to provide a tennis racket which can be carried in a standard size briefcase.

Another object is to provide a tennis racket which can be concealed in one's hand luggage so that fellow travelers are not needlessly aware that a tennis racket is being carried.

Another object is to provide a tennis racket which can be carried into meeting rooms without embarrassment, thus eliminating the chance of ruining a tennis racket by leaving it in a hot parked car.

Another object is to provide means for replaceable detachment of the handle of any standard wood or composite racket which can be incorporated with minimum modification thereto.

Another object is to provide detachable handle means for a tennis racket which have a minimal effect on the weight and center of gravity of a standard tennis racket.

These and other objects and advantages of the present invention will become apparent to those skilled in the art after considering the following detailed specification which covers a preferred embodiment thereof in conjunction with the accompanying drawing wherein:

DETAILED DESCRIPTION OF THE SHOWN EMBODIMENT

Figure 1:
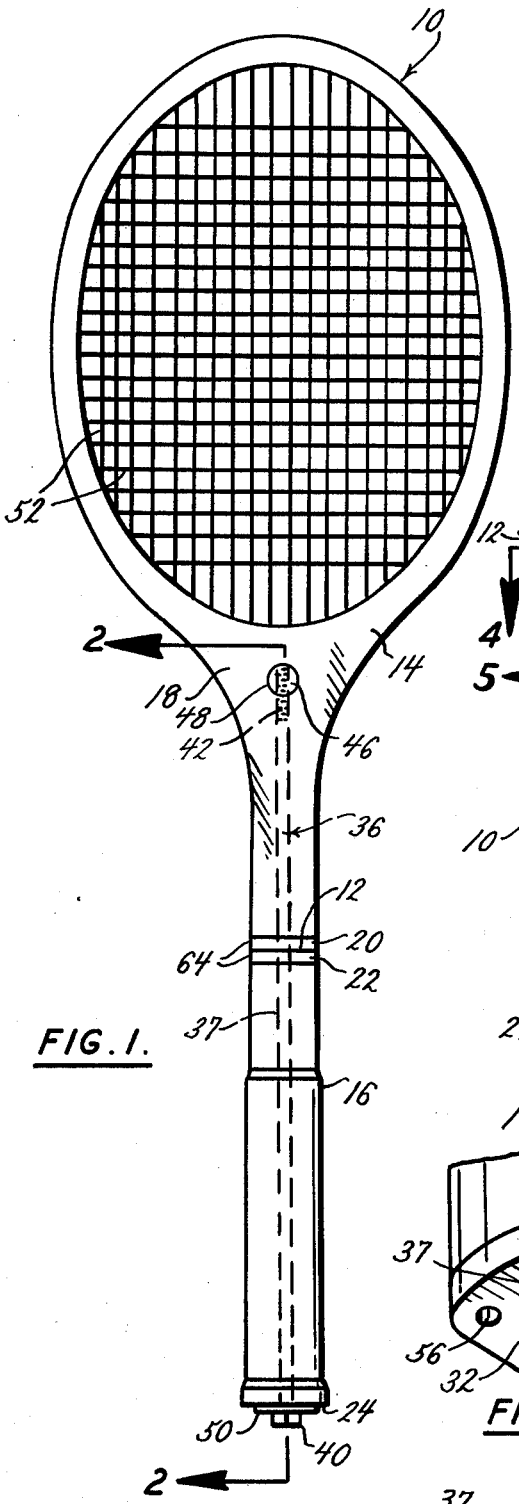
FIG. 1 is an elevational view of tennis racket employing the collapsible feature of the present invention.
Figure 2:
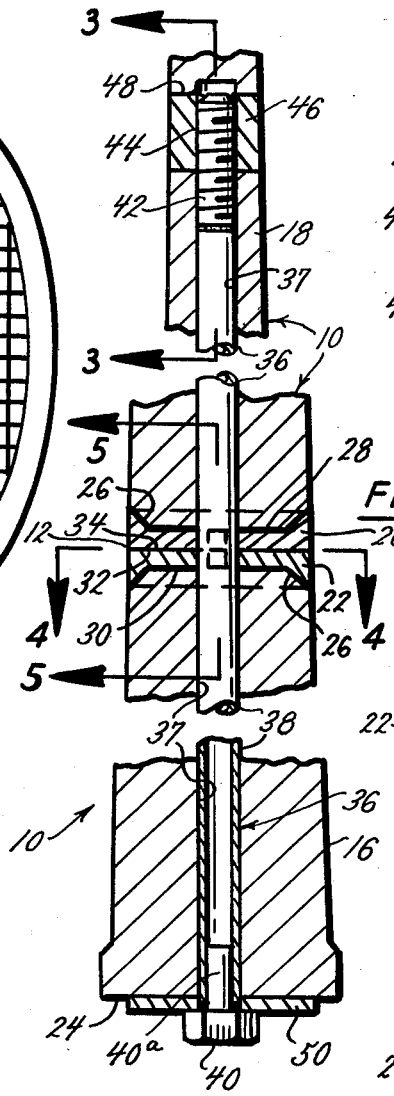
FIG. 2 is an enlarged fragmentary cross-sectional view taken on line 2—2 of FIG. 1.

Referring to the drawing more particularly by reference numbers, number 10 in FIG. 1 refers to a tennis racket 10 constructed or modified in accordance with the present invention. The racket 10 is constructed to split at a part line 12 between the head portion 14 and the handle portion 16 thereof. The critical portions of the racket 10 with respect to the invention are enlarged in FIG. 2, the throat 18, the part-line 12 formed by mating butt plates 20 and 22 and the opposite end 24 of the handle 16 being shown. The butt plates 20 and 22 are held to their respective racket portions 14 and 16 by suitable adhesive 26 and by means of their uniquely shaped back surfaces 28 and 30, to be discussed in detail hereinafter. The butt plates 20 and 22 also include facing abutment surfaces 32 and 34 which are held in surface to surface contact by means of a tension rod 36 which extends through a generally centrally located hole 37 in the portions 14 and 16.

Figure 3:
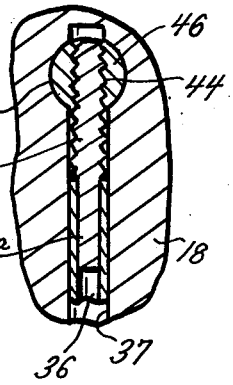
FIG. 3 is a cross-sectional view taken on line 3—3 of FIG. 2.
Figure 4:
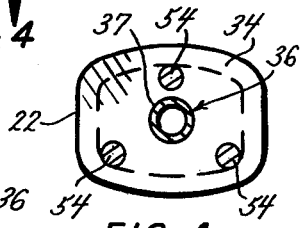
FIG. 4 is a cross-sectional view taken on line 4—4 of FIG. 2.
Figure 5:
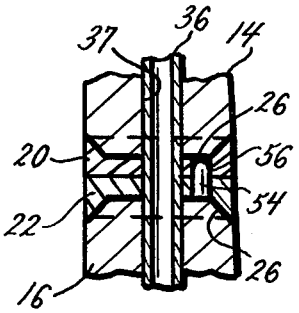
FIG. 5 is a cross-sectional view taken on line 5—5 of FIG. 2.
Figure 6:
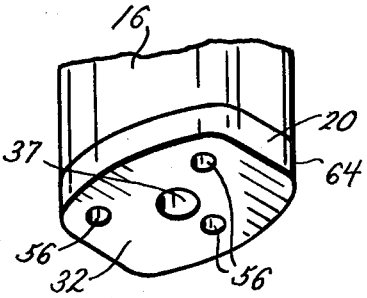
FIG. 6 is a partial perspective view of the butt plate which is connected to the head portion of the racket.
Figure 7:
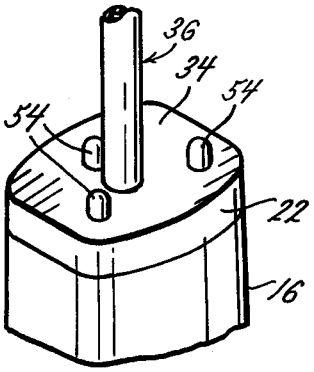
FIG. 7 is a partial, perspective view of a butt plate attached to the handle portion of the racket.

The tension rod 36 is preferably constructed with a central portion 38 made from a high strength material in the shape of a hollow tube for lightness. The rod also includes at one end means for applying torque such as the hexagonal bolt head 40 beyond the end 24 of the handle portion 16. Included at the other end is a threaded portion 42. The bolt head 40 and threaded portion 42 preferably are connected permanently to the hollow tube 38 by means of brazing, welding, or otherwise suitably attaching the small stubs **40*a* and 42*a* which extend within the tube 38 to the tube 38. When the two portions 14 and 16 of the racket are placed together and the torque rod 36 is inserted through the hole 37 into the throat 18 of the racket 10 and torque is applied to the head 40, the threaded portion 42 thereof engages similar threads 44 (FIG. 3) in a transversely positioned fastener 46. It is convenient that the fastener 46 be cylindrical in form so that it can be placed in a drilled hole defined by the cylindrical surface 48 in the racket throat 18. As the threaded portion 42 of the rod 36 engages the threads 44 of the fastener 46, force is applied from the fastener 46 through the butt plates 20 and 22 to the butt head 40 of the rod 36 thus assuring the intimate contact of the abutment surfaces 32 and 34. Bearing means such as a washer 50 may be employed between the handle end 24 and the head 40 to allow easier rotation of the rod 36** and to distribute the force.

There is a considerable amount of torque generated when one using a tennis racket hits a ball in other than the exact center of the strings 52 thereof. Therefore, torque transmission means such as pins 54 are extended from the surface 34 of the butt plate 22. These pins fit into matching holes 56 in the opposite abutment surface 32 of the butt plate 20. The pins 54 and the holes 56 are positioned generally about the periphery of the butt plates 20 and 22 so that a maximum amount of torque can be transmitted thereby. This is shown in FIGS. 4, 5, 6 and 7. The pins 54 also assure proper alignment of the portions 14 and 16.

Figure 8:
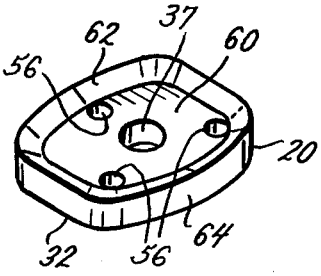
FIG. 8 is a perspective view of a butt plate showing the surface thereof normally in abutment with the wood or composite portion of the racket.

The torque, of course, must also be transmitted from the butt plates 20 and 22 to their respective racket portions 14 and 16. Therefore the back surfaces 28 and 30 thereof are specifically shaped in a similar manner to assure transmittal of the torque. By looking at FIG. 8 which shows the back surface 28 of the butt plate 20, it can be seen that the surface 28 like surface 30 is comprised of a central flat portion 60 and an outer peripheral section 62 which is formed at an oblique angle thereto. The surface 60 acts to resist the force created by the tension rod 36 whereas the outer peripheral section 62 acts as a wedge against the wood or composite material of the tennis racket to assure there is no relative movement therebetween. Of course the outer surface 64 of the butt plate is shaped to match the overall shape of the tennis racket so that the butt plates 20 and 22 merely look like decorative metal bands to the uninitated rather than the functional portions of the disconnect mechanism that they actually are.

Thus there has been shown and described a novel tennis racket with detachable handle which fulfills all of the objects and advantages sought therefor. Many changes, modifications, variations, and other uses and applications of the subject invention will, however, become apparent to those skilled in the art after considering this specification together with the accompanying drawing. All such changes, modifications, variations and other uses and applications which do not depart from the spirit and scope of the invention are deemed to be covered by the invention which is limited only by the claims which follow.

What is claimed is:

1. A racket having a head portion which includes a throat with a fastener abutment surface therein, a handle portion and means to detachably connect said head portion and said handle portions together, said means including:

a first butt plate having an abutment surface connected to said head portion;

a second butt plate having an abutment surface connected to said handle portion, said second butt plate abutment surface being positioned to face and abut said abutment surface of said first butt plate when said portions are connected; and means to force said abutment surfaces together including a tension rod which extends through at least part of said head and handle portions, said rod having a threaded portion and a head portion for the application of torque and to provide means to establish tension thereacross, abutment means to engage said rod head portion connected to said handle portion, and threaded attachment means connected to said head portion of said racket to engage said threaded portion of said rod, said threaded attachment means including a fastener which extends transversely across said throat to engage said fastener abutment surface over an area substantially larger than the surface area of the connected threaded portion of said rod.

2. The racket defined in claim 1 wherein said rod is constructed from at least three pieces fixedly connected together including a threaded piece, a head piece and a hollow rod piece, portions of said head piece and said threaded piece extending into said hollow rod piece.

3. The racket defined in claim 1 wherein said first and second butt plates include torque transmission means which include at least three pins extending from one's abutment surface and mating holes defined by the other through its abutment surface.

4. The racket defined in claim 1 wherein said first and second butt plates each include a side opposite their abutment surfaces which has a central, planar portion to transfer longitudinal forces to said racket portions and a outer peripheral portion with an inner surface therealong which is noncircular in cross-section and is canted at an oblique angle to said planar portion to wedge said butt plates to their respective racket portions and to transmit torques.

5. The racket defined in claim 4 wherein said racket has a body portion with side surfaces where said butt plates are located, said butt plates including outer peripheral edges which extend from said peripheral portions to said abutment surfaces which are shaped to match said sides of said body portion.

* * * * *